United States Patent [19]

Gamberini et al.

[11] Patent Number: 4,865,679

[45] Date of Patent: Sep. 12, 1989

[54] DEVICE FOR APPLYING ADHESIVE ON TO SHEETS OF PACKING MATERIAL

[75] Inventors: Antonio Gamberini; Giorgio Vaccari, both of Bologna, Italy

[73] Assignee: G.D. Societa' Per Azioni, Bologna, Italy

[21] Appl. No.: 80,778

[22] Filed: Aug. 3, 1987

[30] Foreign Application Priority Data

Aug. 8, 1986 [IT] Italy ..... 3485 A/86
Jun. 8, 1987 [IT] Italy ..... 3508 A/87

[51] Int. Cl.[4] ..... B65C 9/14; B65C 9/22

[52] U.S. Cl. ..... 156/497; 118/231; 118/249; 156/571; 156/578; 156/DIG. 31; 156/DIG. 35

[58] Field of Search ..... 156/497, 571, 578, DIG. 31, 156/DIG. 35; 118/231, 236, 249

[56] References Cited

U.S. PATENT DOCUMENTS

| | | | |
|---|---|---|---|
| 3,791,904 | 2/1974 | Schlacht | 156/571 |
| 4,632,721 | 12/1986 | Hoffmann | 156/578 |
| 4,710,257 | 12/1987 | Mattei et al. | 156/578 |
| 4,724,036 | 2/1988 | Hill et al. | 156/497 |

FOREIGN PATENT DOCUMENTS

| | | | |
|---|---|---|---|
| 2167977 | 6/1986 | United Kingdom | 156/578 |

*Primary Examiner*—George F. Lesmes
*Assistant Examiner*—J. Davis
*Attorney, Agent, or Firm*—Marshall, O'Toole, Gerstein, Murray & Bicknell

[57] ABSTRACT

A gumming device for applying adhesive on to cardboard blanks on a packing machine, on which the blanks are fed crosswise in relation to their longer axis by a suction roller the surface of which presents transverse projections which cause the blanks to flex in such a manner as to expose only given portions requiring adhesive to the action of a gumming element substantially tangent to the aforementioned suction roller.

4 Claims, 3 Drawing Sheets

DEVICE FOR APPLYING ADHESIVE ON TO SHEETS OF PACKING MATERIAL

BACKGROUND OF THE INVENTION

The present invention relates to a device for applying adhesive on to sheets of packing material. In particular, the present invention relates to a gumming device for applying adhesive on to cardboard blanks on a packing machine.

Known gumming devices of the aforementioned type comprise a pair of counter-rotating rollers, respectively known as a gumming and pressure roller, arranged substantially tangent to each other along a common generating line located on the straight-line route travelled along by the blanks. The gumming roller often consists of a number of coaxial, cylindrical gumming discs spaced according to the distance between given portions of the blanks to be coated with adhesive. The said discs are partially imersed in a vessel containing adhesive, and present, on their respective cylindrical surfaces, grooves designed to feed adhesive on to the said given portions of the blanks. Fixed scraping means are provided for cleaning the cylindrical surfaces of the gumming discs, so that, subsequent to the action of the said scraping means, only the gum left inside the said grooves is transferred by the discs on to the said given portions of the blanks.

In actual practice, however, and despite careful, precise mating of the said scraping means and the said gumming roller, a thin film of adhesive inevitably clings to the entire cylindrical surface of the said gumming discs, due to the fact that a limitation is posed on the clearance between fixed scrapers and the surface of the said gumming discs, below which minimum clearance the wear on the said scrapers and gumming discs would be intolerable. Consequently, not only the said given portions of the blanks are coated by the gumming device with a thin film of gum, which fact gives rise to a number of drawbacks. One of these is that the packets produced using the said blanks, which often consist of a number of superimposed sheets of packing material, may prove faulty, due to the said sheets being stuck either together or to the contents of the packet. Another is that such fouling of the blanks also results in severe fouling of packing line components on packing machines fitted with the aforementioned type of gumming devices.

SUMMARY OF THE INVENTION

The aim of the present invention is to provide a gumming device designed to eliminate or, in certain cases, remove at least most of the drawbacks typically associated with gumming devices of the aforementioned type.

With this aim in view, according to the present invention, there is provided a device for applying adhesive on to sheets of packing material, in particular cardboard blanks on a packing machine, said device comprising means for feeding the said blanks into a gumming position, and a gumming element for applying adhesive on to given portions of the said blanks in the said gumming position; characterised by the fact that the said feeding means comprise means for flexing the said blanks, which flexing means are designed to define, at least in the said gumming position, portions wherein the said gumming element contacts the said given portions of the said blanks, and portions outside the said given portions and wherein the said gumming element is detached from the said blanks.

BRIEF DESCRIPTION OF THE DRAWINGS

The present invention will be described by way of example with reference to the accompanying drawings, in which.

DETAILED DESCRIPTION OF THE INVENTION

Figure 1:
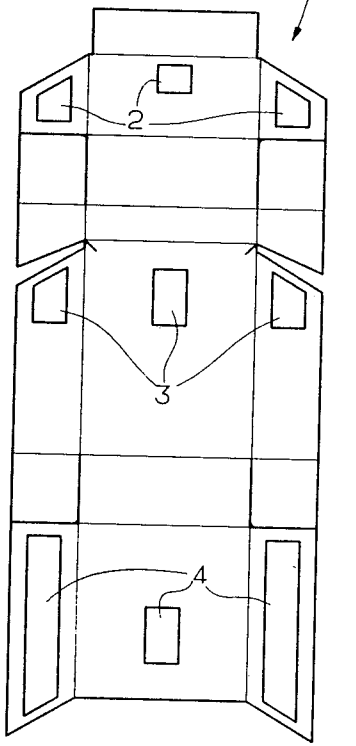
FIG. 1 shows a cardboard blank, given portions of which are designed to be coated with adhesive by a gumming device in accordance with the teachings of the present invention.

Number 1 in FIG. 1 indicates a cardboard blank designed for packing a given product. By way of example in the following description, the said product consists of a group of cigarettes (not shown) designed to be packed inside blank 1 to produce a packet of cigarettes of the hard-pack type.

Figure 3:
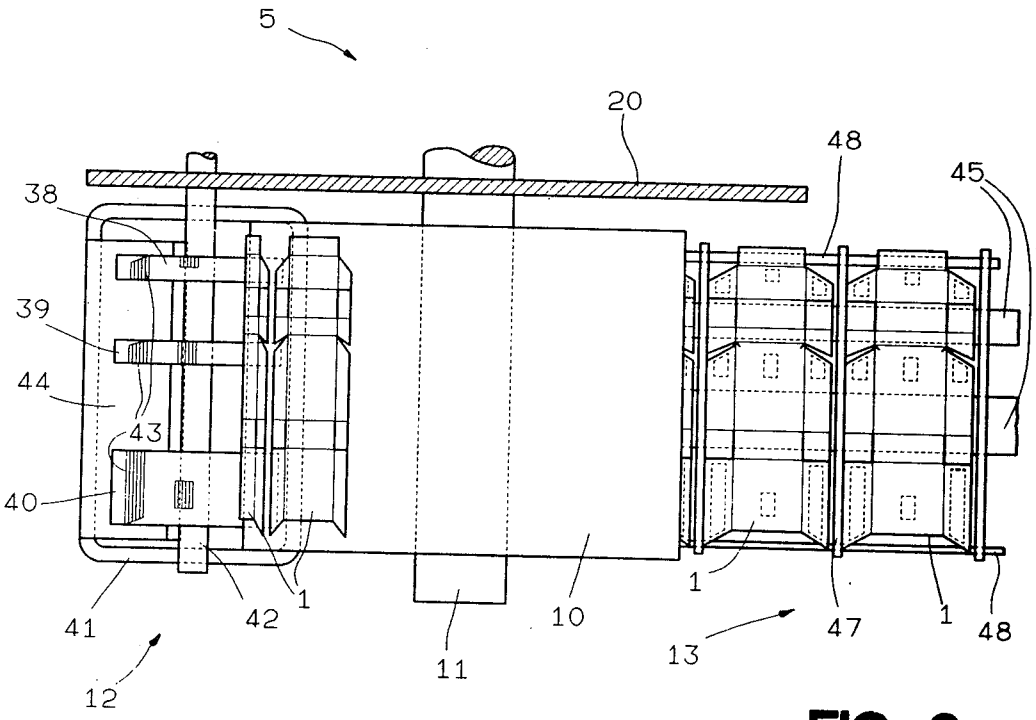
FIG. 3 shows a schematic plan view along line III—III in FIG. 2.
Figure 2:
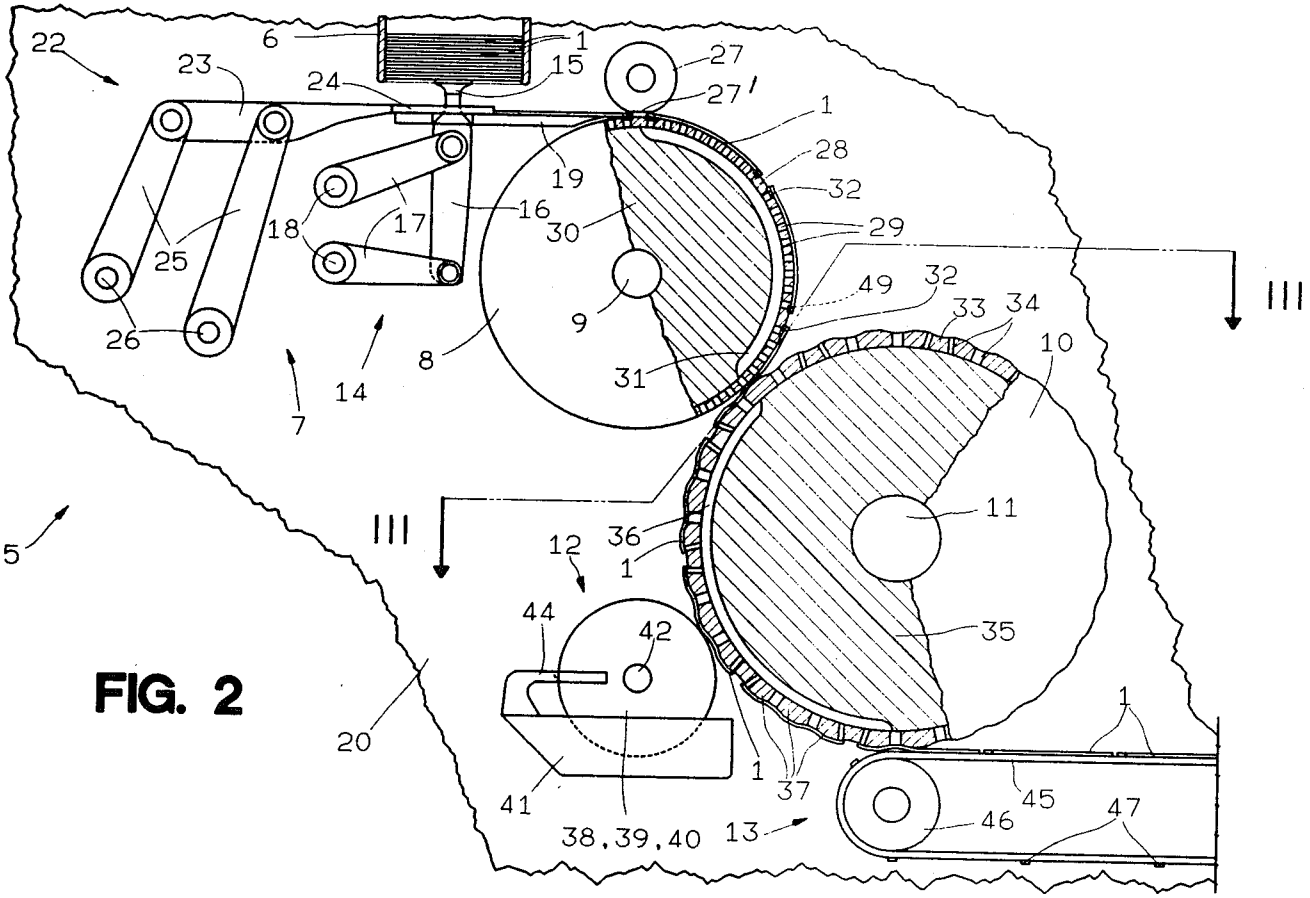
FIG. 2 shows a schematic, partially-sectioned front view of a first embodiment of the device according to the present invention.

Numbers 2, 3 and 4 indicate parallel gum patches of different shapes and sizes applied on to given portions of blank 1 by a gumming device indicated as a whole by 5 in FIGS. 2 and 3. In more detail, numbers 2, 3 and 4 each indicate three gum patches applied to the top end, middle and bottom end of blank 1 respectively (as viewed in FIG. 1). The three centre patches 2, 3 and 4 are aligned in a row parallel with the longitudinal axis of blank 1, whereas the right- and left-hand patches 2, 3 and 4 (as viewed in FIG. 1) form respective rows arranged symmetrically in relation to the said centre row.

Gumming device 5 comprises a store 6 inside which blanks 1 are stacked, and a pick-off device 7 designed to withdraw blanks 1 one at a time from the bottom of store 6 and transfer them, crosswise in relation to their longer axis, to a suction type transfer roller 8 supported on and turned clockwise by a horizontal shaft 9. Roller 8 transfers blanks 1 one at a time to a feeding means consisting of a gumming roller 10 substantially tangent to roller 8 and supported on and turned anticlockwise at the same surface speed as roller 8 by a shaft 11 parallel with shaft 9. While blanks 1 are held by suction on to the surface of roller 10, a gumming device 12, operating in what is referred to as the gumming position, coats one face with gum patches 2, 3 and 4 arranged as shown in FIG. 1. Blanks 1 are then fed one at a time on to a conveyor belt 13, which provides for feeding them on to a packing line (not shown).

As shown in FIG. 2, pick-off device 7 comprises a pick-off element 14 having suckers 15 (only one of which is shown in FIG. 2) and connected to a suction source (not shown) via ducts and distributor means (not shown) described in more detail later on. The said pick-off element 14 is supported at the bottom on a substantially vertical rocker arm 16 connecting the free ends of two substantially horizontal connecting rods 17, the other ends of which are connected to respective shafts 18 and which form part of an articulated quadrilateral. Drive means (not shown), forming part of the packing machine on which gumming device 5 is installed, turn connecting rods 17 about respective shafts 18, thus causing rocker arm 16 to move up and down substantially vertically. At the end of each upstroke, the said rocker arm 16, by means of the said suckers 15, withdraws a blank 1 from store 6 and, as it moves down, places it on a horizontal top 19 resting on the bed 20 of device 5 and provided with openings 21 (only one of which is shown in FIG. 2) enabling passage of the top end of rocker arm 16 and suckers 15.

Number 22 indicates a push device forming part of pick-off device 7 and located to the left of pick-off element 14 in FIG. 2. The said push device 22 consists of an articulated quadrilateral, a substantially horizontal rocker arm 23 of which supports, on its right end (as shown in FIG. 2), a push element consisting of a substantially horizontal plate 24. The said rocker arm 23 connects the free ends of two substantially vertical connecting rods 25 connected at the bottom to respective shafts 26 parallel with shafts 18. The said drive means powering pick-off element 14 also turn connecting rods 25 about respective shafts 26, thus causing rocker arm 23 to move back and forth substantially horizontally. At the end of each downstroke of pick-off element 14, rocker arm 23 moves plate 24 to the right (FIG. 2), so as to engage the edge of blank 1 with the edge of plate 24, and slide blank 1 along top 19 up to the said suction roller 8.

Roller 8, which, at the blank 1 receiving point, is substantially tangent to a pressure roller 27 turning anticlockwise at a surface speed equal to the travelling speed of blanks 1, consists of a hollow cylindrical skirt 28 integral with shaft 9 and having radial holes 29 arranged on the surface as described in more detail later on, and a fixed cylindrical element 30 arranged inside skirt 28 and in airtight manner in relation to the inner surface of the same. The peripheral surface of cylindrical element 30 presents, in known manner and over substantially the whole of its width, a depression or slot 31 connected (in a manner not shown) to a suction source (not shown). With reference to the direction of rotation of skirt 28, the said slot 31 extends between the said point of substantial tangency of rollers 27 and 8, and a point of substantial tangency between roller 8 and the said gumming roller 10. Holes 29 are arranged over the portions of skirt 28 required to receive and retain, by force of suction, blanks 1 supplied successively by push device 22.

With reference to the rotation direction of roller 8, each portion of skirt 28 supporting, in use, the rear edge of blank 1, presents an element for flexing the said rear edge; which element consists of a rib 32 parallel with shaft 9 and projecting from the surface of skirt 28 in such a manner as to detach by a given length, and for reasons explained in more detail later on, the said rear edge of each blank 1 from the surface of skirt 28.

The said gumming roller 10 consists of a hollow, substantially cylindrical skirt 33 integral with shaft 11 and having pneumatic retaining means consisting of substantially radial holes 34 arranged over its surface as described in more detail later on; and a fixed cylindrical element 35 arranged inside skirt 33 and in airtight manner in relation to the inner surface of the same. The peripheral surface of cylindrical element 35 presents, in known manner and over substantially the whole of its width, a depression or slot 36 connected (in a manner not shown) to the said suction source communicating with slot 31. With reference to the rotation direction of skirt 33, the said slot 36 extends between the point of substantial tangency of rollers 8 and 10 and a point of substantial tangency between gumming roller 10 and the said conveyor belt 13.

The peripheral surface of skirt 33 presents a number of projections 37 parallel with its axis and so producing an undulated skirt 33. The said projections 37, which, together with the said holes 34, constitute means for flexing the said blanks 1, are arranged on skirt 33 in groups of three having the same spacing as blanks 1 supplied by roller 8. The distance between projections 37 in each said group of three is the same as the crosswise distance between gum patches 2, 3 and 4 on the blank in FIG. 1.

Holes 34 are located on the portions of skirt 33 between the said projections 37, in such a manner as to define, for each said group of three projections 37, two respective suction portions between the two end projections 37 and the centre projection 37, and a further two suction portions adjacent to the respective end projections 37 on the outside of the group.

The said gumming device 12, which, as shown in FIGS. 2 and 3, is adjacent to the route travelled along by blanks 1 on gumming roller 10, comprises a gumming element or roller consisting of three gumming discs 38, 39 and 40 (FIG. 3) arranged side by side and partially imersed in a vessel 41 containing adhesive.

Discs 38, 39 and 40 are supported and turned clockwise (FIG. 2) by a horizontal shaft 42 parallel with shafts 9 and 11, supported on bed 20 of gumming device 5, and connected (in a manner not shown) to a motor (not shown) on the packing machine (not shown) on which device 5 is installed.

Depending on the said given portions of blanks 1 to which gum patches 2, 3 and 4 are to be applied, the peripheral surface of each gumming disc 38, 39 and 40 presents groups of grooves 43 parallel with the axis of shaft 42 and arranged side by side in the rotation direction of discs 38, 39 and 40.

The periphery and sides of gumming discs 38, 39 and 40 are skirted by a sharp-edged scraper element 44 designed to remove excess adhesive from the periphery and sides of rotating discs 38, 39 and 40, leaving only a given amount inside grooves 43.

Downstream from gumming device 12, gumming roller 10 is substantially tangent to the said conveyor belt 13 which, as shown also in FIG. 3, comprises two horizontal conveyor belts 45 supported and powered at the same speed as roller 10 by two end rollers 46 (only one of which is shown) having their axes parallel with the axis of shaft 11. As shown in FIG. 3, the said belts 45 are spaced in such a manner that the top branches touch only given portions of blanks 1 which have not been coated with adhesive. Belts 45 are connected together by a number of transverse slats 47, each pair of which defines a compartment for housing a single blank 1 supplied by roller 10.

Two rods 48, parallel with the travelling direction of belts 45, are supported by bed 20 on opposite sides of the top branch of conveyor 13, and constitute two supporting and sliding elements for the gumfree longitudinal ends of blanks 1 carried on conveyor 13.

In actual use, blanks 1 are withdrawn successively from store 6 by pick-off element 14, the suckers 15 of which are connected by the said distributor means to the said suction source in known manner in the time interval between the instant in which suckers 15 move up to the bottom blank 1 in store 6, and the instant in which rocker arm 16 moves down to place blank 1 on to top 19. Push device 22 than transfers blanks 1 successively between transfer roller 8 and pressure roller 27, thus causing the said blanks 1, which are fed crosswise in relation to their longer axis, to cling to the surface of skirt 28 by virtue of the suction force exerted through holes 29.

Roller 8, which, together with pick-off device 7 and roller 10, constitutes a means for feeding blanks 1 into the said gumming position, then transfers blanks 1 successively towards gumming roller 10 by which the said blanks 1 are received and, by virtue of the suction force exerted through holes 34, held firmly on to skirt 33, each blank 1 resting on three consecutive projections 37 forming each said group, with its longitudinal axis arranged astride the middle projection 37 of the respective said group.

Consequently, on roller 10, each blank 1 is flexed and, thanks also to the action of one of the said ribs 32 which flexes its rear edge for improving adhesion to the peripheral surface of gumming roller 10, is undulated crosswise in relation to its travelling direction, so as to present its centre and two side edge portions projecting outwards of skirt 33.

As each blank 1 travels through the point of substantial tangency between gumming roller 10 and gumming device 12, gumming discs 38, 39 and 40, turning at the same surface speed as roller 10, bring their portions with the said grooves 43 into contact with the portions of blank 1 projecting furthest from skirt 33 of roller 10, so as to coat the said portions with the said gum patches 2, 3 and 4. The undulated arrangement of blanks 1 on roller 10 therefore prevents any contact between gumming device 12 and the portions of blanks 1 between the said projections 37, which are thus safeguarded against fouling by the adhesive.

Blanks 1 are than fed successively off gumming roller 10 on to conveyor belt 13, where, subsequent to interruption of the suction force exerted through holes 34, they return to their normal flat position. Each time a blank 1 is fed on to conveyor 13, a slat 47 engages its rear edge and forces it along rods 48 towards the said packing station (not shown).

From the foregoing description, gumming device 5 according to the present invention clearly provides for eliminating all the drawbacks associated with the current state of the art, in cases where the said gum patches 2, 3 and 4 extend over the entire width of gumming discs 38, 39 and 40. In fact, as gumming discs 38, 39 and 40 only come into contact with the said most radially projecting portions of blanks 1, there is absolutely no possibility of a film of adhesive being applied outside the said portions designed to receive the said gum patches 2, 3 and 4.

Only in cases where the said gum patches extend over a portion of blank 1 shorter than the axial dimension of the respective gumming discs (e.g. centre patch 4) may a film of adhesive be applied outside the said given portions. In fact, as already stated in the introductory section, scraper 44 fails to remove all the adhesive from the cylindrical, albeit perfectly smooth surface of the gumming discs. As a result, a thin film of adhesive is applied on to blanks 1 whenever they come into contact with the gumming discs.

Figure 4:
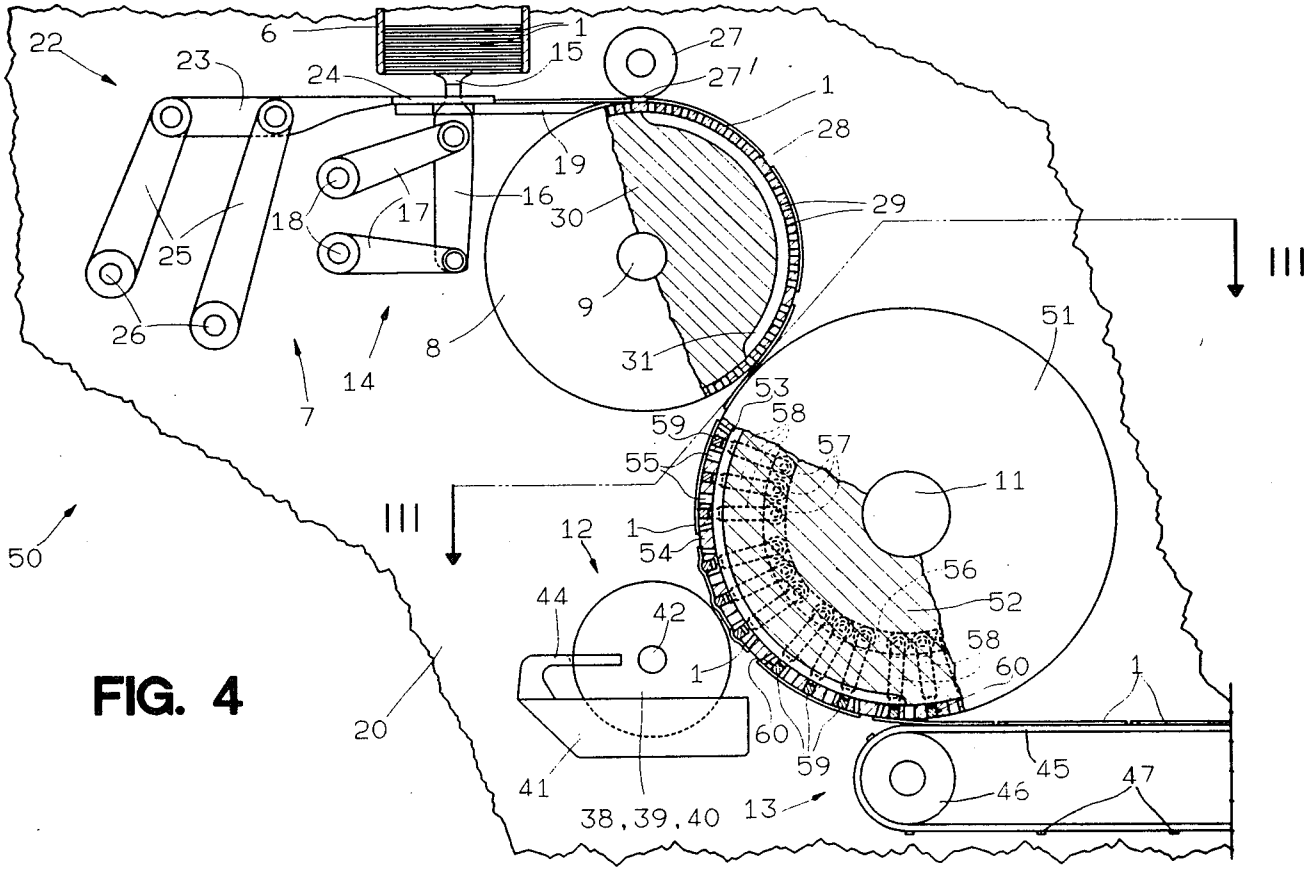
FIG. 4 is similar to FIG. 2 and shows a second embodiment of the device according to the present invention.

The FIG. 4 embodiment shows a gumming device 50, the component parts of which, with the exception of gumming roller 10, are identical to those of device 5, and therefore indicated using the same reference numbers.

The only difference between devices 50 and 5 is that device 50 presents a shaft 11 fitted with a feeding means comprising a gumming roller 51, in turn, comprising a fixed cylindrical body 52 having a suction slot 53 similar to slot 36, and an annular skirt 54 designed to turn on body 52 with shaft 11 and having pneumatic retaining means consisting of radial suction holes 55 similar to holes 34.

Body 52 is fitted with an integral cam 56 cooperating with tappet rollers 57, each of which is fitted to the end of a respective rod 58 located at the back of body 52 and extending radially in relation to shaft 11. The outer end of each rod 58 is fitted integral with a flexing means comprising a projection consisting of a mobile element 59 extending parallel with the axis of shaft 11 and mounted inside a respective slot 60 formed in skirt 54, so as to slide, inside the same, radially in relation to roller 51.

The outer periphery of each element 59 defines a portion of the outer surface of roller 51, and elements 59 are arranged over the outer periphery of roller 51 in the same manner as projections 37 on roller 10. The elements in each pair of adjacent elements 59 are separated by a row of suction holes 55.

Cam 56 is designed in such a manner as to maintain elements 59 in the retracted position, wherein the outer periphery of elements 59 is level with the outer surface of skirt 54, and to move each element 59 radially outwards by a given amount, usually a few tenths of a millimeter, as element 59 moves through the point of tangency between roller 51 and gumming device 12, thus producing, as far as gumming is concerned, the same effect as projections 37 on device 5.

As the outer periphery of roller 51 is perfectly cylindrical at the point of tangency with roller 8, ribs 32 on roller 8 may be dispensed with on device 50.

To those skilled in the art it will be clear that changes may be made to gumming device 5 as described and illustrated herein without, however, departing from the scope of the present invention.

As shown by the dotted line in FIG. 2, in addition or by way of an alternative to the said ribs 32, provision may be made for flexing elements consisting of ribs 49 located on each portion of skirt 28 supporting, in use, the front edge of blank 1, viewed according to the rotation direction of roller 8; the purpose of the said ribs 49 being to detach the front edge of blank 1 by a given amount from the surface of skirt 28, and so adapt blank 1 to the undulated surface of gumming roller 10.

To prevent interference with either the said ribs 32 or ribs 49, the peripheral surface of pressure roller 27 presents a flat portion 27'.

We claim:

1. A device for applying adhesive on to blanks of sheet material, each blank having a front and a rear transverse end, the device comprising feeding means for transversely feeding said blanks in succession to and past a gumming position, and a gumming element for applying adhesive on to given portions of each said blank at the gumming position;

the feeding means comprising a rotary gumming roller designed to turn about its own axis and cooperating with the gumming element and having a peripheral surface provided with a number of projections each cooperating, in use, with a portion of a respective blank at least at the gumming position, and with peripheral suction means located between each pair of adjacent projections; and a rotary suction roller for feeding the blanks in succession to the gumming roller, and having a peripheral surface to which the blanks adhere;

the feeding means also comprising a pick-off device for withdrawing the blanks one at a time from a store in which the blanks are stacked; the suction roller for transferring the said blanks being located between the pick-off device and the gumming roller;

peripheral flexing elements being provided on the gumming roller for contacting and flexing at least in the gumming position the rear end portion, and portions outside of the rear end portion, of each blank outwards from the peripheral surface of the gumming roller;

flexing elements provided on the suction roller comprising a number of projections provided on the peripheral surface of the suction roller and beneath the rear portions of the blanks and a number of pneumatic means for retaining the blanks on the suction roller and with one of the pneumatic retaining means being located between each pair of adjacent projections; and at least one of the portions of the suction roller to which the front and rear ends of each said blank respectively adhere, viewed according to the rotation direction of the suction roller, presents a flexing element for flexing the end of the blank, and the flexing element comprises a transverse rib projecting from the peripheral surface of the suction roller.

2. A device as claimed in claim 1 wherein the projections are fixed and evenly spaced projections;

the peripheral surface of the gumming roller being an undulated surface with undulations extending parallel with an axis of rotation of the gumming roller; and with each undulation being defined by a projection.

3. A device as claimed in claim 1 wherein the gumming roller is provided with a number of peripheral movable elements, which are mounted on the gumming roller to move in a radial direction in relation to the peripheral surface thereof, and with actuating means for moving each peripheral element, as it travels thorough the gumming position from a normal retracted position into an extended position, wherein the peripheral element defines a respective projection.

4. A device as claimed in claim 1 wherein the gumming element comprises at least one rotary gumming disc substantially tangent to the peripheral surface of the gumming roller, the gumming disc being provided with groups of peripheral grooves arranged according to given portions of the blanks.

* * * * *